US005533726A

United States Patent [19]

Nordman et al.

[11] Patent Number: 5,533,726

[45] Date of Patent: Jul. 9, 1996

[54] MAGNETIC CRANE FOR A PINBALL GAME

[75] Inventors: Dennis P. Nordman, Des Plaines; Winston H. Schilling, Park Ridge, both of Ill.

[73] Assignee: Williams Electronics Games, Inc., Chicago, Ill.

[21] Appl. No.: 247,088

[22] Filed: May 20, 1994

[51] Int. Cl.[6] ..... A63F 7/30

[52] U.S. Cl. ..... 273/119 R; 273/121 A; 273/121 D; 273/126 A

[58] Field of Search ..... 273/118 R, 121 A, 273/448, 121 B, 121 E

[56] References Cited

U.S. PATENT DOCUMENTS 4,848,748 7/1989 Krutsch .
5,356,142 10/1994 Borg .
5,358,242 10/1994 Trudeau et al. ..... 273/119 A

OTHER PUBLICATIONS

"Premier to the Rescue", *Replay Magazine*, pp. 57–48 dated May, 1994, Gottlieb.

*Primary Examiner*—Vincent Millin
*Assistant Examiner*—Charles Anderson
*Attorney, Agent, or Firm*—Rockey, Rifkin and Ryther

[57] ABSTRACT

The improved player feature of the invention comprises an arm mounted for rotation about a vertical axis. An electromagnet is attached to the arm's outer end which is capable of suspending a ferromagnetic ball. Located below and along the path traveled by the magnet are a plurality of play features such as ramps, chutes, outholes and the like. A ball elevator is provided to bring the pinball to the electromagnet. The electromagnet is rotated over the play features. When the magnet is aligned with a desired play feature, the player presses a button to deactivate the electromagnet thereby dropping the ball onto the desired feature.

10 Claims, 4 Drawing Sheets

MAGNETIC CRANE FOR A PINBALL GAME

BACKGROUND OF THE INVENTION

The present invention relates generally to pinball games and, more particularly, to an improved play feature for such games which is designed to foster and to maintain player interest therein.

A typical pinball game includes an inclined playfield which supports a rolling ball, a plurality of play features such as targets, bumpers, ramps and the like and player operated flippers. The player controls the flippers, which are mounted on the playfield, to direct the ball at desired play features thereby to score points and control play of the game.

As will be appreciated, the success of a manufacturer's line of pinball games depends on its ability to attract players to its games. To attract players, it is necessary to provide new, exciting and challenging play features that test the player's skill in addition to entertaining the player.

Increasingly, games are provided with play features that require player involvement beyond the use of the flippers. Play features such as these require player skill to complete. An example of such a skill shot is the ball cannon disclosed in U.S. Pat. No. 5,186,462 issued to Biagi et al.

Thus, a novel play feature for a pinball game which attracts and entertains players by requiring more player involvement is desired.

SUMMARY OF THE INVENTION

The invention comprises a horizontally oriented arm mounted for rotating motion about a vertical axis, the arm carrying an electromagnet at its outer end that is capable of suspending a ferromagnetic ball. Located directly below the path traveled by the magnet as the arm rotates are a plurality of play features such as ramps, chutes, outholes and the like.

The game player shoots the pinball onto a ball elevator which is provided to lift the pinball to the electromagnet. The arm carrying the ball is then rotated over the play features. When the magnet is aligned with a desired one of the play features, the player presses a button to deactivate the electromagnet thereby dropping the ball onto the desired play feature.

DETAILED DESCRIPTION OF A PREFERRED EMBODIMENT

Figure 1:
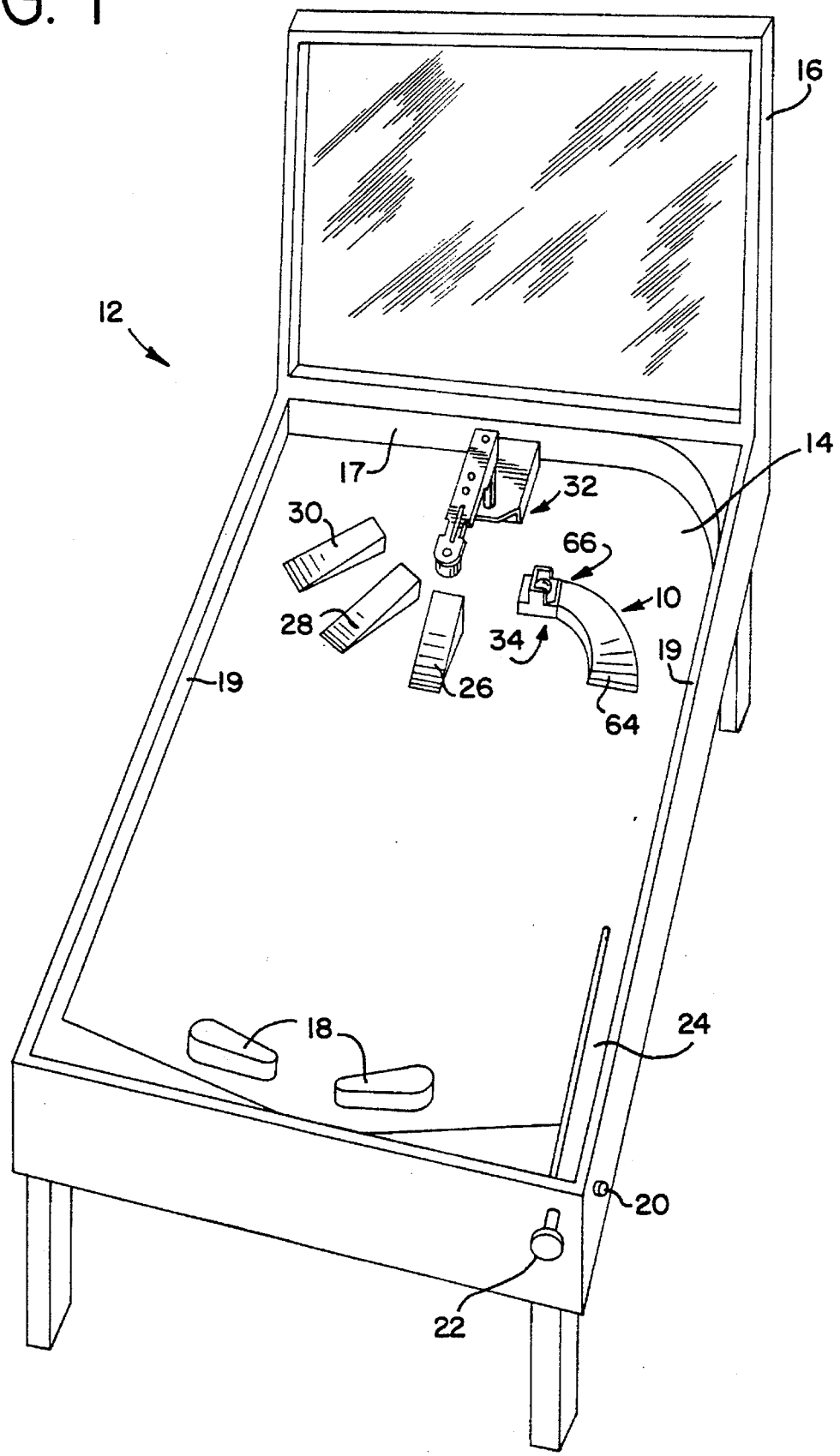
FIG. 1 is a perspective view of a pinball game including the magnetic crane-like play feature of the invention.

Referring to FIG. 1, a perspective view of the improved play feature 10 of the invention mounted on a pinball game 12 is illustrated. A typical pinball game includes an inclined playfield 14, vertical back box 16 containing a game microprocessor 17 (FIG. 4), a pair of flippers 18, flipper control switches 20, shooter 22, shooter lane 24 (for introducing a ball onto the playfield) and a ferromagnetic pinball. FIG. 1 also shows a plurality of ramps 26–30 each of which leads to other play features (not shown for clarity) incorporated on playfield 14. Each ramp is capable of receiving balls discharged from feature 10.

Figures 2, 2A:
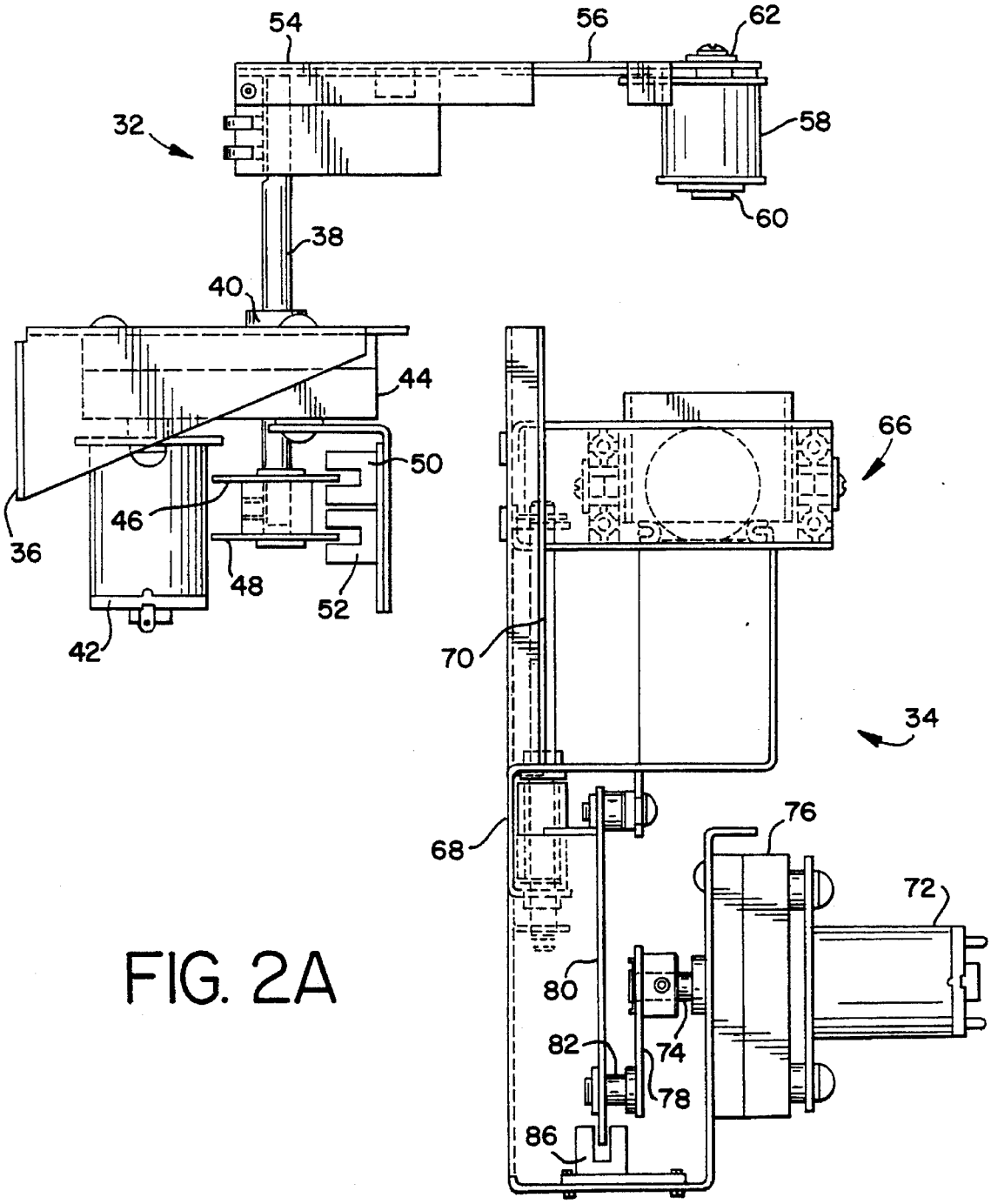
FIG. 2 is a side view of the rotatable lifter arm assembly.
FIG. 2A is a side view of the ball elevator assembly.

Referring to FIGS. 2 and 2A, a side view of the rotatable arm assembly 32 and the ball elevator assembly 34 are illustrated. The play feature 10 comprises the combination of arm assembly 32 and elevator assembly 34. In the illustrated embodiment, pinballs can be directed into ball receiver 66 of elevator assembly 34 via playfield ramp 64 (FIG. 1) by means of a skill shot. Alternatively, balls could be directed onto ramp 64 by ricochet off of another play feature.

Arm assembly 32 is mounted above playfield 14 by support bracket 36. Support bracket 36 supports a substantially vertical shaft 38 mounted for rotational movement in a bearing 40. It should be appreciated that arm assembly 32 can also be mounted level with or below playfield 14 such that shaft 38 extends through a playfield aperture (not shown) to rotate the lifter arm. In this case, pinballs can be immediately directed into ball receiver 66 from playfield 14 without requiring use of ramp 64.

Shaft 38 is rotated by reversible motor 42 via gear reducer 44. Motor 42 is reversibly driven such that shaft 38 rotates as shown by arrow A in FIG. 3. Optical switches 50 and 52 are connected to bracket 36 and, when interrupted by discs 46 and 48 which are carried by the shaft 38, generate a signal which is sent to microprocessor 17 (see FIG. 4) to control the drive of motor 42. Typically, the motor drive is reversed each time lifter arm 56 reaches the outer ramps 26 and 30 (FIG. 1). Thus, optical switch and interrupter disc pairs 46 and 50 and 48 and 52 function as limit switches in a manner well known in this art.

Arm 56 is mounted on top of shaft 38 at end 54. The arm 56 rotates with shaft 38 about this end and includes a coil assembly 58 and an electromagnet 60 which are attached to its distal end 62. In its initial position, electromagnet 60 is disposed directly above ball receiver 66. Electromagnet 60 is energized (via a wire pair not shown for clarity) when a pinball is directed into grommet 88 due to the closure of optical switch 84 shown in FIG. 3 and as described hereafter.

Ball elevator assembly 34 preferably is attached above playfield 14 by means of support bracket 68. A pair of vertical guide posts 70 are mounted on bracket 68. Ball receiver 66 is slidably attached to vertical guide posts 70 and is moved from a lowered, ball receiving position to a raised, ball discharge position as discussed later. In the lowered position, ball receiver 66 is capable of receiving pinballs from ramp 64. When ball receiver 66 is in the raised position, a ball disposed therein is in close proximity to electromagnet 60 such that the ball is removed from receiver 66 when magnet 60 is energized.

Alternatively, ball elevator assembly 34 is mounted at or below the level of playfield 14. In this case, ball receiver 66 is positioned in a playfield aperture (not shown) when it is in its lowered position. Pinballs can be immediately directed into ball receiver 66 from playfield 14 without the use of ramp 64.

Motor 72 rotates horizontal shaft 74 via gear reducer 76. The rotation of shaft 74 is translated into vertical motion of ball receiver 66 by the action of linkage 78, 80 and 82. Optical switch 84 (shown in FIG. 3) signals the game microprocessor to actuate motor 72 when a pinball is received in grommet 88, thus raising ball receiver 66. When ball receiver 66 returns to its lowered position, optical switch 86 is closed by link 80 which signals the game microprocessor to deactivate motor 72.

Figures 3, 3A:
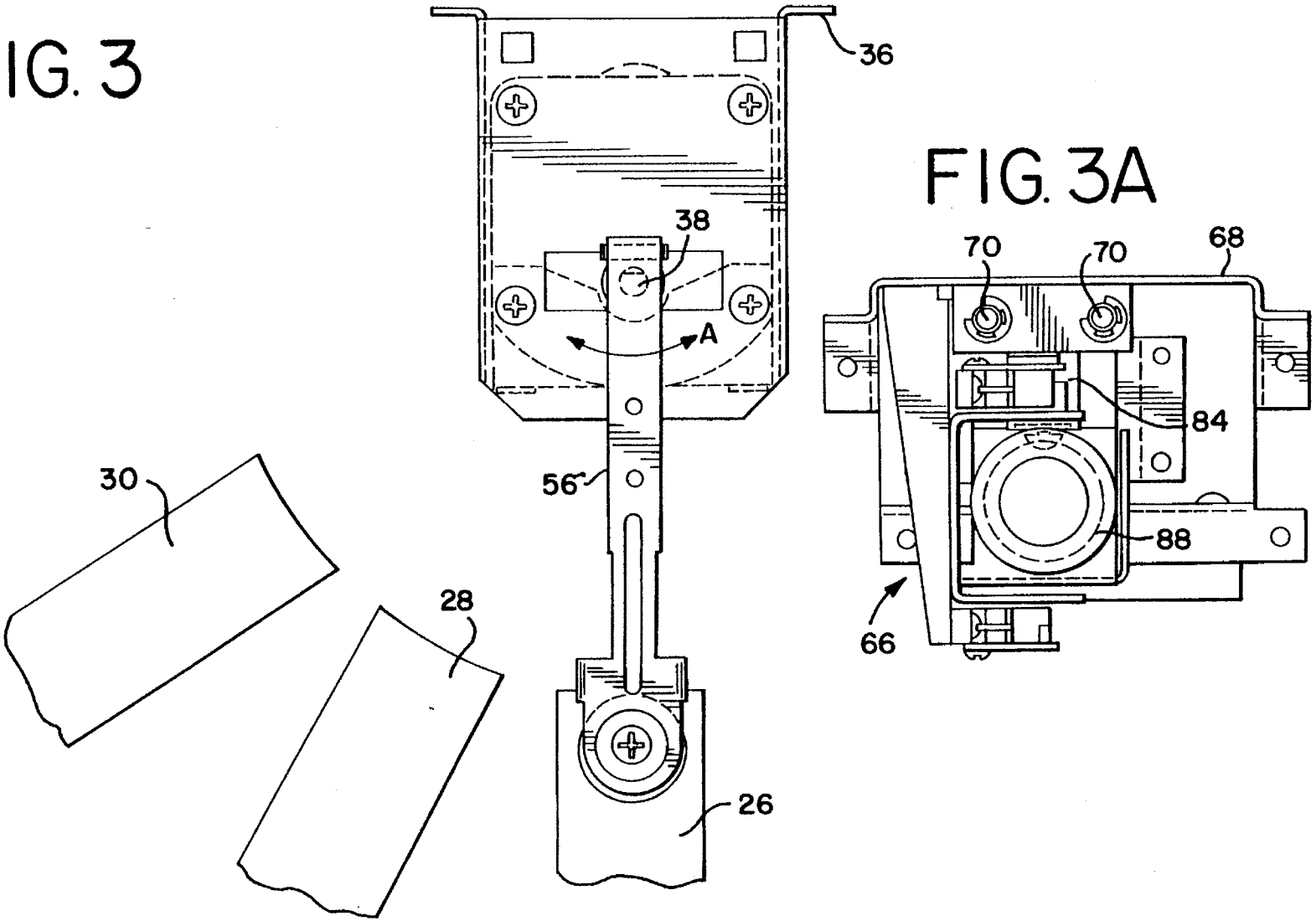
FIG. 3 is a top view of the rotatable lifter arm.
FIG. 3A is a top view of the ball elevator assembly.

Referring to FIGS. 3 and 3A, top views of the assemblies 32 and 34 are illustrated. Arm 56 is horizontally rotatable about the axis of shaft 38 in the direction of arrow A from a position directly over receiving grommet 88 to a position directly over the most distant one of playfield ramps shown in FIG. 1. The optical switch and interrupter disc pairs 46 and 50 and 48 and 52 serve to limit the rotation of lifter arm 56 to the angular extent of ramps 26–30.

Figure 4:
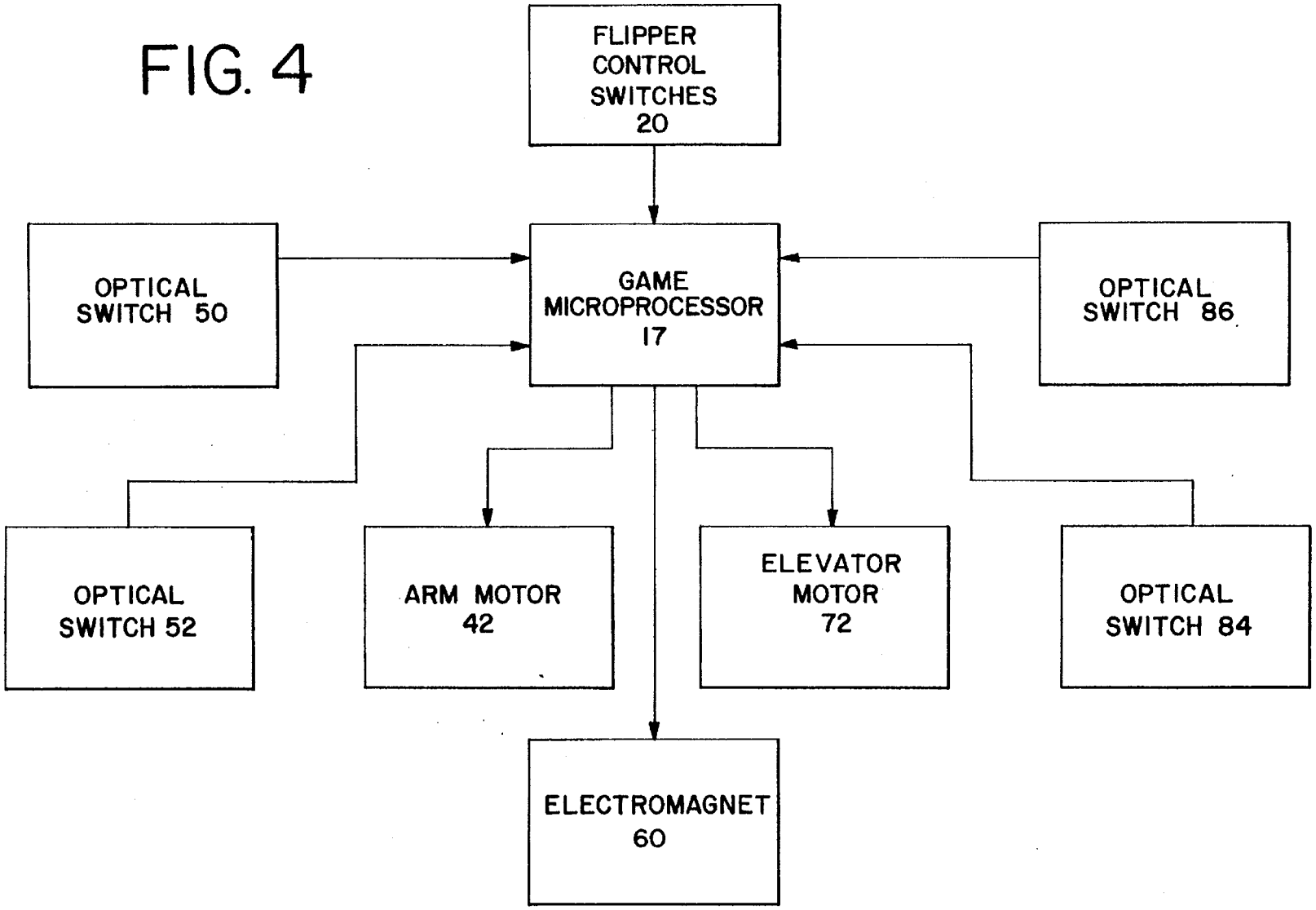
FIG. 4 is a block diagram showing the electrical connections between the play feature and the game microprocessor.

FIG. 4 illustrates the electrical connections of the magnetic crane to the game microprocessor 17. Microprocessor 17 activates elevator motor 72 in response to a signal sent from optical switch 84 and deactivates motor 72 in response to a signal sent from optical switch 86. Signals sent from optical switches 50 and 52 cause game microprocessor 17 to reverse the drive of arm motor 72 as discussed later. Also, player activation of control switches 20 signals microprocessor 17 to deenergize electromagnet 60.

The operation of the magnetic crane is as follows. Initially, lifter arm 56 is positioned such that electromagnet 60 is vertically disposed over grommet 88. When a player directs a ball from playfield 14 over ramp 64 and into grommet 88, optical switch 84 is closed. This actuates motor 72 and signals the game microprocessor system to energize the electromagnet 60. Magnet 60 can be energized as the ball receiver 66 comes into proximity with it.

Actuation of motor 72 raises the ball receiver 66 by means of the rotation of shaft 74 and linkage 78–82. When receiver 66 approaches its fully raised position, the pinball at rest in grommet 88 will be removed therefrom due to the magnetic attraction of electromagnet 60. After ball removal, receiver 66 is lowered due to the action of linkage 78–82. Motor 72 is deactivated when link 80 closes optical switch 86, thus leaving receiver 66 in its lowered ball receiving position.

Closing optical switch 84 also signals the game microprocessor system to actuate motor 42. This initiates rotation of lifter arm 54 from its initial position over grommet 88. The optical switch and interrupter disc pairs 46 and 50 and 48 and 52 serve to limit the rotation of lifter arm 56 to the angular extent of ramps 26–30 while the ball is suspended from electromagnet 60.

The object of the invention is for the player to activate one of the flipper switches 20 to discharge a ball suspended from electromagnet 60 onto a selected one of ramps 26–30. Activation of a flipper switch signals the game microprocessor 17 to deenergize magnet 60 to release the ball. Different point values can be assigned to ramps 26–30 such that the player's score can be maximized by discharging a suspended ball onto the ramp associated with a maximum score. If the player does not activate switches 20 after a predetermined period of time, the microprocessor deenergizes magnet 60 to release the ball back to the playfield.

It should be appreciated that any number of ramps 26–30 could be provided as long as the ramps utilized are positioned to receive a ball discharged from the electromagnet. Also, a plurality of targets could be utilized in place of ramps 26–30 such that a player's score could be increased by dropping a suspended ball onto a target.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. In combination, a play feature for transporting a ferromagnetic ball and an inclined playfield for supporting the ball, the combination comprising:

(a) an inclined playfield;

(b) a ball elevator secured to the playfield for receiving a ball from the playfield and lifting it to a ball discharge position;

(c) an arm rotatable above the playfield having an electromagnet mounted thereon for removing the ball from said elevator and transporting it to a player selected position above the playfield; and (d) means for controlling movement of said arm over said playfield and for discharging the ball from said electromagnet at a selectable position on the playfield.

2. The combination of claim 1 wherein said ball elevator is mounted above the playfield, said play feature further comprising means for delivering a ball from the playfield to said ball elevator.

3. The combination of claim 2 wherein said means for delivering comprises a ramp.

4. The combination of claim 1 wherein said ball elevator is mounted below the playfield and includes a ball receiver disposed in the playfield aperture for lifting a ball directly received from the playfield.

5. The combination of claim 1 wherein said electromagnet is energized when a ball is received on said ball elevator.

6. The combination of claim 1 further comprising a plurality of ramps secured to the playfield, said arm being rotatable over said ramps.

7. The combination of claim 6 wherein a ball is transported to a position above a player selected ramp and is discharged thereon by deenergizing said electromagnet.

8. The combination of claim 1 further comprising a player operated button, said means for controlling being responsive thereto.

9. The combination of claim 1 wherein said means for controlling includes a game microprocessor, said play feature further comprising a sensor for detecting when a ball is received in said elevator, said microprocessor being responsive to said sensor.

10. The combination of claim 1 further comprising player operated means for selecting the position on the playfield at which said ball is discharged, said means for controlling being responsive thereto.

* * * * *